US010590584B2

(12) United States Patent
Yoon et al.

(10) Patent No.: US 10,590,584 B2
(45) Date of Patent: Mar. 17, 2020

(54) LAUNDRY TREATING APPARATUS

(71) Applicant: LG ELECTRONICS INC., Seoul (KR)

(72) Inventors: Jongsun Yoon, Seoul (KR); Unkeol Yeo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 110 days.

(21) Appl. No.: 15/669,545

(22) Filed: Aug. 4, 2017

(65) Prior Publication Data

US 2018/0038032 A1 Feb. 8, 2018

(30) Foreign Application Priority Data

Aug. 8, 2016 (KR) ..... 10-2016-0100805

(51) Int. Cl.

| | |
|---|---|
| ***D06F 37/14*** | (2006.01) |
| ***D06F 39/00*** | (2020.01) |
| ***D06F 39/08*** | (2006.01) |
| *D06F 37/06* | (2006.01) |
| *D06F 17/10* | (2006.01) |
| *D06F 39/10* | (2006.01) |

(52) U.S. Cl.

CPC ..... *D06F 37/145* (2013.01); *D06F 39/005* (2013.01); *D06F 39/088* (2013.01); *D06F 17/10* (2013.01); *D06F 37/065* (2013.01); *D06F 39/083* (2013.01); *D06F 39/085* (2013.01); *D06F 39/10* (2013.01)

(58) Field of Classification Search

CPC ..... D06F 37/145

See application file for complete search history.

(56) References Cited

U.S. PATENT DOCUMENTS

2013/0139558 A1* 6/2013 Kim ..... D06F 21/02 68/140

FOREIGN PATENT DOCUMENTS

| | | | |
|---|---|---|---|
| CN | 2773129 | Y | 4/2006 |
| CN | 102362027 | A | 2/2012 |
| CN | 103132278 | A | 6/2013 |
| JP | 2015-139600 | A | 8/2015 |
| KR | 10-2005-0114779 | A | 12/2005 |

* cited by examiner

*Primary Examiner* — Jason Y Ko

(74) *Attorney, Agent, or Firm* — Dentons US LLP

(57) ABSTRACT

A laundry treating apparatus comprises a cabinet; a tub provided inside the cabinet, receiving water therein; a drum provided inside the tub, storing laundry therein; a path portion provided in the drum, providing a moving path of the water; a water flow formation portion rotatably provided inside the drum, partially discharging the water inside the drum to the path portion during rotation; and a guide portion provided in the drum, guiding the water discharged by the water flow formation portion to the path portion, wherein the guide portion includes an anti-vortex member for preventing vortex of the water passing through the guide portion.

20 Claims, 8 Drawing Sheets

LAUNDRY TREATING APPARATUS

CROSS-REFERENCE TO RELATED APPLICATIONS

This application claims the benefit of the Korean Patent Application No. 10-2016-0100805, filed on Aug. 8, 2016, which is hereby incorporated by reference as if fully set forth herein.

BACKGROUND OF THE INVENTION

Field of the Invention

The present invention relates to a laundry treating apparatus.

Discussion of the Related Art

A laundry treating apparatus of the related art includes a tub in which water is stored, a drum rotatably provided inside the tub to receive laundry therein, a water flow formation portion rotatably provided inside the drum, a path portion discharges water inside the drum toward the outside of the drum and then resupplying the water into the drum, and a filter for filtering the water entering the path portion.

The laundry treating apparatus of the related art, which has the aforementioned structure, separates particles from the laundry by rotating the water flow formation portion, and separates the water from the laundry by rotating the drum. Also, the laundry treating apparatus of the related art allows the water inside the drum to circulate through the path portion by controlling RPM of the water flow formation portion, whereby the water is filtered. At this time, the laundry treating apparatus of the related art includes a guide portion that communicates the drum and the path portion with each other to circulate the water inside the drum toward the path portion.

The guide portion is a member for communicating an outer wall of the drum with an inlet provided in the path portion, and could be provided in a single body with the drum or detachably from the drum. The guide portion of the laundry treating apparatus of the related art serves to deliver the water supplied by rotation of the water flow formation portion to the path portion.

At this time, in the laundry treating apparatus of the related art, the water rotated in the water flow formation portion enters the guide portion slanted or to form a curve. Also, if a rotational direction of the water flow formation portion in the laundry treating apparatus of the related art is frequently changed, a direction of the water entering the guide portion is also frequently changed. In this way, the water entering the guide portion slanted or to form a curve generates vortex by colliding with an inner wall of the guide portion.

Also, since a flow rate of the water entering the center of the guide portion is different from that of the water entering the guide portion in contact with the inner wall of the guide portion, vortex is generated on the inner wall of the guide portion.

Also, since the guide portion is attached to the outside of the drum in the laundry treating apparatus of the related art, a path area inside the guide portion is rapidly changed in accordance with a shape of the drum, whereby vortex is generated.

In the laundry treating apparatus of the related art, since vortex is generated by the aforementioned various causes, a problem occurs in that the water inside the drum fails to enter the path portion.

Also, in the laundry treating apparatus of the related art, since the water fails to enter the path portion sufficiently, a problem occurs in that a function of the filter provided in the path portion is remarkably deteriorated.

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus that inhibits occurrence of vortex on a guide portion.

Another object of the present invention is to provide a laundry treating apparatus that inhibits occurrence of vortex from an inner wall of a guide portion.

Still another object of the present invention is to provide a laundry treating apparatus that inhibits occurrence of vortex between a guide portion and an outer wall of a drum.

Further still another object of the present invention is to provide a laundry treating apparatus that ensures a flow rate of water entering a path portion.

Further still another object of the present invention is to provide a laundry treating apparatus that may actively circulate water of a lower portion of a drum toward an upper portion of the drum.

Further still another object of the present invention is to provide a laundry treating apparatus that effectively removes particles contained in water received in a drum by allowing the water of a high flow rate to pass through a filter.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus comprises a cabinet; a tub provided inside the cabinet, receiving water therein; a drum provided inside the tub, storing laundry therein; a path portion provided in the drum, providing a moving path of the water; a water flow formation portion rotatably provided inside the drum, partially discharging the water inside the drum to the path portion during rotation; and a guide portion provided in the drum, guiding the water discharged by the water flow formation portion to the path portion, wherein the guide portion includes an anti-vortex member for preventing vortex of the water passing through the guide portion.

The drum includes a cylindrical drum body providing a space where laundry is stored, and a drum base provided on a lower surface of the drum body, constituting a bottom of the drum, the drum base including a circumference portion extended from the drum body to form an outer circumference of the drum base, having an inlet communicated with the path portion, and a receiving portion extended from an inner circumference of the circumference portion to provide a space where the water flow formation portion may be received, having a cutting portion provided at one side to allow the water to be discharged out by the water flow formation portion.

The path portion includes a path body provided in the drum body, forming a path moving the water near the drum base to an upper side of the drum body, and an inlet provided below the path body to allow the water to enter the path portion.

The guide portion is detachably provided in the drum, and includes a guide body coupling a lower surface of the cutting portion with an outermost surface of the inlet, and a guide plate provided at both sides of the guide body, coupling both sides of the cutting portion with both sides of the inlet to form a path that allows the water moving in the guide body not to leak out.

The guide body includes an inlet portion provided at one end, into which the water flows from the cutting portion, and an outlet portion provided at the other end, discharging the water to the inlet, and the anti-vortex member includes at least one or more guide ribs extended from the inlet portion to the outlet portion, partitioning the guide body.

The guide ribs are provided at the center of the guide body.

The guide ribs include a first guide rib spaced apart from the guide plate provided at one side of the guide body at a certain interval, and a second guide rib spaced apart from the guide plate provided at the other side of the guide body at a certain interval.

The first guide rib and the second guide rib are close to each other from the inlet portion to the outlet portion.

The guide body includes an inlet portion provided at one end, into which the water flows from the cutting portion, and an outlet portion for discharging the water to the inlet, and the anti-vortex member further includes a partition portion that connects the guide plates with each other.

The partition portion is provided to be spaced apart from the guide body at a height the same as or higher than that of the cutting portion.

The partition portion is extended at a certain length in parallel with the bottom of the tub.

The partition portion is provided to be extended from an upper surface of the cutting portion to the inlet in parallel with the guide body and spaced apart from the inlet at a certain length.

The partition portion is provided to be extended from an upper surface of the cutting portion to an innermost surface of the inlet.

The water flow formation portion includes a water flow forming body forming a main body, an agitating blade provided to be protruded on the water flow forming body, an agitating laundry, and a pumping blade protruded below the water flow forming body, pushing the water of the drum base.

The receiving portion includes a first step difference surface extended from an inner circumference of the circumference portion to a lower portion thereof, a second step difference surface extended from the first step difference surface in parallel with the bottom of the tub, a third step difference surface extended from an inner circumference of the second step difference surface to a lower portion thereof, and a bottom surface extended from the third step difference surface in parallel with the bottom of the tub, the first and second step difference surfaces provide spaces for receiving the water flow forming body, and the third step difference surface and the bottom surface provide spaces for receiving the pumping blade.

The guide plates include a front guide plate supporting the second step difference surface and a rear guide plate provided in a single body with the front guide plate, supporting the circumference portion, and the guide rib includes a front guide rib supporting the second step difference surface and a rear guide rib provided in a single body with the front guide rib, supporting the circumference portion.

The anti-vortex member further includes a partition portion provided in parallel with the guide body at a height the same as the front guide plate and the front guide rib, contacting the third step difference surface provided with the cutting portion by connecting the rear guide plates and the rear guide ribs with one another.

The partition portion is extended at a certain length in parallel with the bottom of the tub.

The partition portion is extended from the upper surface of the cutting portion to the inlet in parallel with the guide body, and is provided to be spaced apart from the inlet at a certain length.

The partition portion is provided to be extended from the upper surface of the cutting portion to the innermost surface of the inlet.

The water flow formation portion includes an agitating blade exposed inside the drum to stir laundry, and a pumping blade rotated to be spaced apart from the agitating blade, and the agitating blade and the pumping blade are rotated at their respective directions different from each other or their respective speeds different from each other.

The laundry treating apparatus further comprises a filter portion detachably provided in the path portion to filter the water moving from the path portion to the upper side of the drum body.

According to one embodiment of the present invention, a laundry treating apparatus may be provided, which inhibits occurrence of vortex on a guide portion.

According to one embodiment of the present invention, a laundry treating apparatus may be provided, which inhibits occurrence of vortex from an inner wall of a guide portion.

According to one embodiment of the present invention, a laundry treating apparatus may be provided, which inhibits occurrence of vortex between a guide portion and an outer wall of a drum.

According to one embodiment of the present invention, a laundry treating apparatus may be provided, which ensures a flow rate water entering a path portion.

According to one embodiment of the present invention, a laundry treating apparatus may be provided, which may actively circulate water of a lower portion of a drum toward an upper portion of the drum.

According to one embodiment of the present invention, a laundry treating apparatus may be provided, which effectively removes particles contained in water received in a drum by allowing the water of a high flow rate to pass through a filter.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 4(*b*) further illustrates an embodiment of the guide portion illustrated in FIG. 4(*a*);

FIG. 4(*c*) further illustrates an embodiment of the guide portion illustrated in FIG. 4(*a*);

FIG. 5(*c*) further illustrates the anti-vortex member provided in the guide portion of the embodiment illustrated in FIG. 5(*a*);

FIG. 6(*b*) further illustrates the anti-vortex member provided in the guide portion of the embodiment illustrated in FIG. 6(*a*);

FIG. 7(*b*) further illustrates the anti-vortex member provided in the guide portion of the embodiment illustrated in FIG. 7(*a*);

FIG. 8(*b*) further illustrates the anti-vortex member provided in the guide portion of the embodiment illustrated in FIG. 8(*a*).

DETAILED DESCRIPTION OF THE INVENTION

Reference will now be made in detail to the preferred embodiments of the present invention, examples of which are illustrated in the accompanying drawings.

All the terms of this specification refer to general meanings of the terms in the art understood by those skilled in the art to which the present invention pertains, and if the terms used in this specification collide with general meaning of the terms in the art, the terms follows definition used in this specification.

Meanwhile, elements or control method of an apparatus, which will be described below, are only intended to describe the embodiments of the present invention and are not intended to restrict the scope of the present invention. Wherever possible, the same reference numbers will be used throughout the drawings to refer to the same or like parts.

Figure 1:
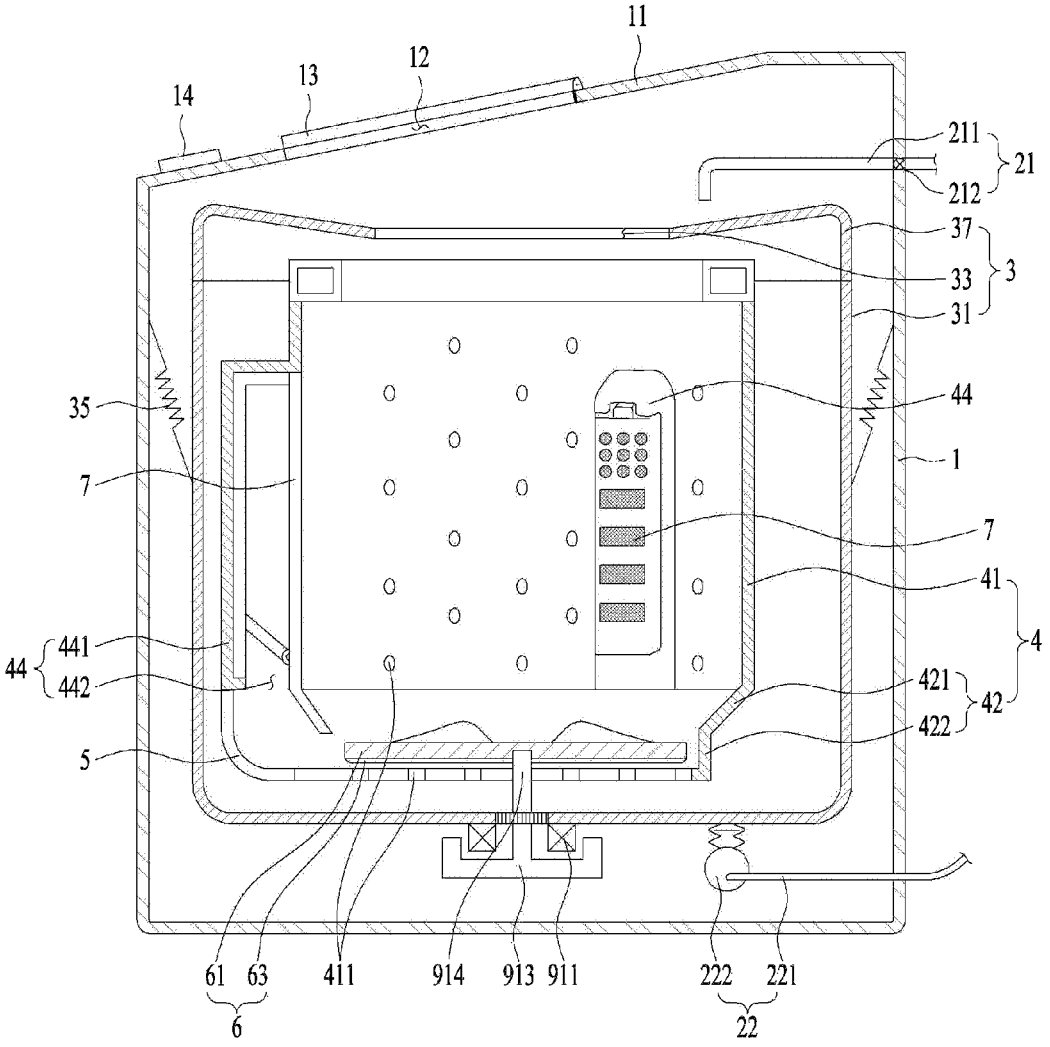
FIG. 1 illustrates a laundry treating apparatus according to one embodiment of the invention.

As shown in FIG. 1, a laundry treating apparatus according to one embodiment of the present invention may include a cabinet 1 forming external appearance, a tub 3 provided inside the cabinet 1, storing water therein, and a drum 4 provided inside the tub 3, storing laundry therein.

The cabinet 1 includes an inlet 12 for putting laundry into the drum or taking out the laundry stored in the drum, and a door 13 opening or closing the inlet 12.

The laundry treating apparatus 100 according to one embodiment of the present invention may be provided in a top load type in which the inlet 12 is provided on an upper panel 11 provided on an upper portion of the cabinet 1. However, the laundry treating apparatus 100 may also be provided in a front load type in which the inlet 12 is provided at the front of the cabinet 1.

The upper panel 11 may be provided in parallel with the ground. Also, as shown in FIG. 1, the upper panel 11 may be provided slanted, or may be provided slanted such that the rear of the cabinet 1 may be higher than the front thereof. This is to ensure a space where various elements such as a water supply unit 21 may be installed in the cabinet 1 by enlarging the volume of the upper area of the cabinet 1 and at the same time to allow a user to easily access an inlet 33 of the tub 3.

A control panel 14 for controlling the operation of the laundry treating apparatus may be provided at the front of the upper panel 11, and a display unit (not shown) for displaying a current state of the laundry treating apparatus may be provided at the front of the upper panel 11.

The tub 3 provided to be received in the cabinet 1 may include a tub body 31 providing a space where the water is stored, and a tub inlet 33 provided on an upper surface of the tub body 31, communicating with the inlet 12. Also, the tub 3 may include a tub cover 37 to prevent the water received in the tub 3 from flowing backward and being discharged out. The tub cover 37 is provided above the tub body 31, and includes the tub inlet 33 on its inner circumference.

The tub body 31 may be fixed to the cabinet 1 through a tub support unit 35. The tub support unit 35 may include a spring, a damper, etc. to attenuate vibration of the tub 3.

The tub body 31 may store the water supplied from the water supply unit 21. The water supply unit 21 may include a water supply pipe 211 connected with an external water supply source, and a water supply valve 212 controlling a flow rate of the water moving in the water supply pipe 211 by controlling an opening of the water supply pipe 211. Also, although not shown, the water supply pipe 211 may be provided to be divided into a cool water pipe and a hot water pipe.

The water supply pipe 211 may be provided to be extended from the water supply valve 212 to the upper portion of the tub inlet 33, or may be provided to communicate with one side of the tub cover 37 or one side of the tub body 31. That is, the water supply pipe 211 may be provided in all shapes or structures that may supply the water to the tub 3.

The water stored in the tub 3 is discharged to the outside of the cabinet 1 through a drainage unit 22, which includes a drainage pipe 221 and a drainage pump 222 to guide the water inside tub 3 to the outside of the cabinet 1.

Although not shown, the drainage pipe 221 may be provided to be extended from the bottom of the tub 3 to the upper portion of the tub 3 at a certain length such that the tub 3 may store the water therein.

The drum 4 may include a drum body 41 providing a space where laundry is stored, and a drum base 42 constituting the bottom of the drum 4. The drum body 41 may be provided with a drum inlet 43, which is communicated with the tub inlet 33, at an upper portion.

The drum body 41 and the drum base 42 may rotatably be provided inside the tub 3, and the inner surface of the drum body 41 and the drum base 42 may be provided with a plurality of through holes 411 for allowing the water inside the tub 3 to enter the drum 4.

Meanwhile, a path portion 44, which may move the water at the lower end of the drum 5 to the upper portion of the drum 5 may be provided on the inner circumference of the drum body 41. That is, the path portion 44 may be provided to be extended from the drum base 42 to a certain height of the inner circumference of the drum body 41.

The path portion 44 may include a path body 411 constitutes a main body of the path portion 44 and forming a path moving the water near the drum base 42 to the upper side of the drum body 41, and an inlet 442 provided below the path body 441 to allow the water inside the drum 4 to enter the path portion 44. At this time, although the path body 441 may be formed as a path where the water from the lower portion of the drum 4 moves to the upper portion of the drum 4, the path body 441 may be provided as a housing having an opening toward the drum body 41.

The path body 441 may be provided on an outer wall of the drum body 41, or may be provided to be extended from the drum base 42 to the inner circumference of the drum body 41.

The path body 441 may be provided on the outer wall of the drum body 41, and its one surface may form one surface of the drum body 41.

The drum 4 may further include a cutting portion 423 provided to pass through the drum base 42 so as to deliver the water received in the drum 4 to the path portion 44. As a result, the water inside the drum 4 may be discharged to the cutting portion 423 and enter the inlet 412 provided in the path portion 44. That is, the water inside the drum 4 may be discharged to the outside of the drum body 41 and then again enter the path portion 44 provided in the drum body 41.

Meanwhile, the path portion 44 may include a filter portion 7 filtering the water flown to the path portion 44 and then discharging the water to the drum.

Since the filter portion 7 should again discharge the water flown to the path portion 44 to the drum 4, it is preferable that the filter portion 9 is provided on one surface toward the drum body 41 of the path body 441.

Also, the filter portion 7 may form one surface of the path body 441, or may be provided as a separate member from the path body 441 and then provided detachably from the path portion 44. As a result, the filter portion 7 may be provided to form the inner circumference of the drum body 41.

The water in the lower portion of the drum 4 enters the path portion 44, and particles contained in the water received in the drum 4 may be removed during the process of discharging the water to the filter portion 7.

Meanwhile, the drum 4 may include a water flow formation portion 6 forming a pressure and water flow for allowing the water inside the drum 4 to be discharged to the cutting portion 423 and then to enter the path portion 44.

The water flow formation portion 6 may rotatably be provided in the drum base 42, or may be rotated separately from the drum 4. The water flow formation portion 6 may form a water flow by rotating in the drum base 42 and partially discharge the water of the drum 4 to the cutting portion 423.

The water flow formation portion 6 may include a disk shaped water flow forming body 61 received in the drum base 42, an agitating blade 62 provided to be protruded on the water flow forming body 61 and radially extended from the water flow forming body 61, and a pumping blade 63 protruded below the water flow forming body 61, pushing the water of the drum base 42.

At this time, a length of the agitating blade 62 and the pumping blade 63 may be smaller than a diameter of the water flow forming body 61 to derive stable rotation of the water flow formation portion 6 and minimize interference with the drum base 42.

The water flow formation portion 6 serves to deliver a mechanical force to the laundry received in the drum 4 due to the agitating blade 62 or improves a washing power by forming a water flow inside the drum body 41.

Also, the water flow formation portion 6 may serve to circulate the water of the drum 4 by allowing the water received in the drum 4 due to the pumping blade 63 to enter the path portion 44.

The water flow formation portion 6 may be rotated by a driving portion 9, which includes a stator 911 fixed to the outside of the tub body 31, generating a rotation electric field, a rotor 913 rotated by the rotation electric field of the stator 911, and a rotational shaft 914 connecting the water flow formation portion 6 with the rotor 913 by passing through the bottom of the tub body 31.

If the water flow formation portion is rotated by the driving portion 9, the water stored in the drum 4 may move along the rotational direction of the agitating blade 42 and the pumping blade 63.

At this time, since the water flow formation portion 6 is provided in the drum base 42, it is preferable that the driving portion 9 is provided at the lower end of the tub 3.

Meanwhile, the drum 4 may further include a guide portion provided on the outer wall of the drum 4, guiding the water discharged to the outside of the drum 4 by the water flow formation portion 6 to the path portion 44.

That is, the drum 4 and the path portion 44 may be communicated with each other by the guide portion 5.

Figure 2:
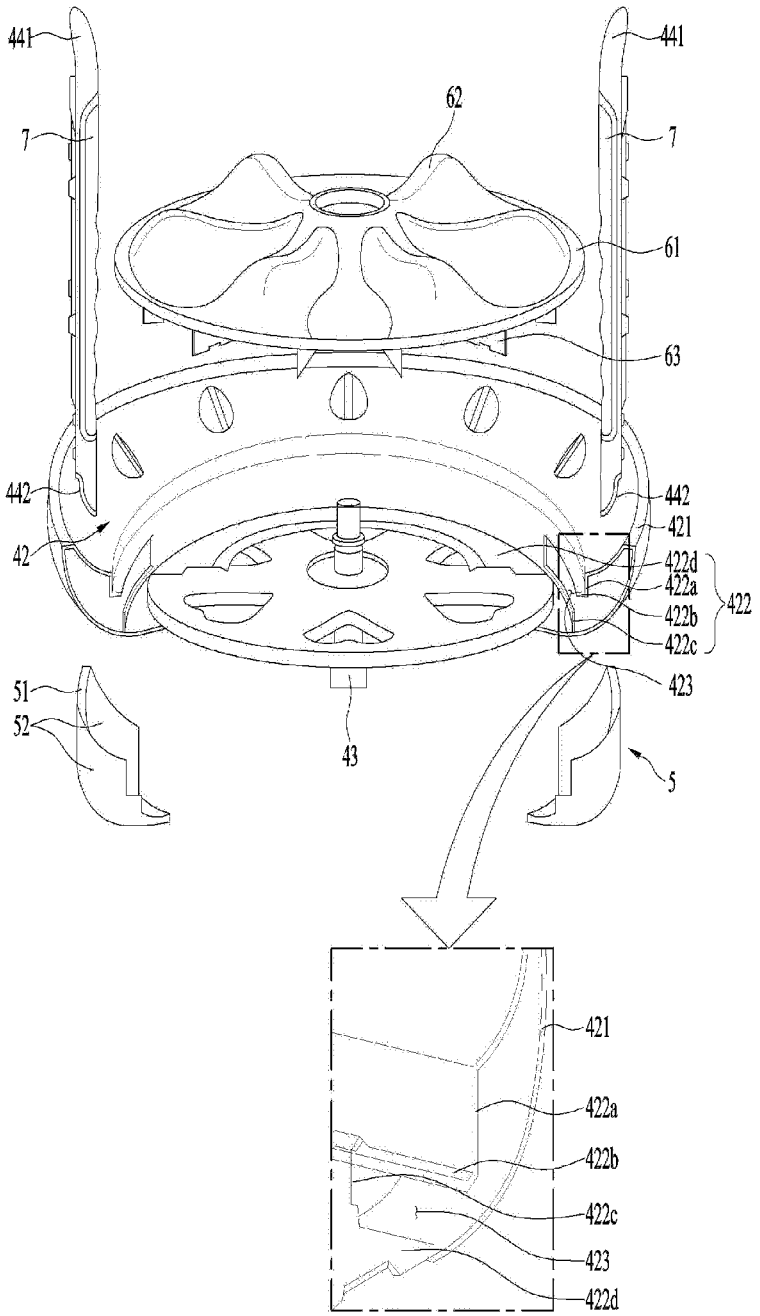
FIG. 2 illustrates a structure of a drum, a water flow formation portion, a driving portion, a path portion and a guide portion.

Hereinafter, a structure of the water flow formation portion, the drum base and the guide portion will be described in detail with reference to FIG. 2.

The drum base 42 may include a circumference portion 421 extended from the drum body 41 to form the outer circumference of the drum base 42, and a receiving portion 422 provided to have a step difference from the circumference portion 421, receiving the water flow formation portion therein.

The receiving portion 422 may include a first step difference surface 422*a* extended from the inner circumference of the circumference portion 421 to the lower portion thereof, a second step difference surface 422*b* extended from the first step difference surface 422*a* in parallel with the bottom of the tub 3, a third step difference surface 422*c* extended from the inner circumference of the second step difference surface to the lower portion thereof, and a bottom surface 422*d* extended from the third step difference surface 422*c* in parallel with the bottom of the tub 3.

Therefore, the first step difference surface 422*a* and the second step difference surface 422*b* may receive the water flow forming body 61 while the third step difference surface 422*c* and the bottom surface 422*b* may receive the pumping blade 63.

The cutting portion 423 may be provided at a portion of one surface of the third step difference surface 422*c*, which corresponds to the path portion 44, to pass through the third step difference surface 422*c*. As a result, the water received in the drum base 42 when the pumping blade 63 is rotated may be discharged to the cutting portion 423 and then enter the path portion 44 along the guide portion 5.

The guide portion 5 may include a guide body 51 connecting the lower portion of the cutting portion 423 with the outermost surface of the inlet 442, and a guide plate 52 provided at both sides of the guide body 51, forming a path so as not to leak out the water moving in the guide body 51.

That is, the guide plate 52 connects both sides of the cutting portion 423 with both sides of the inlet 442. The guide body 51 serves as a vane guiding the water, which has passed through the cutting portion 423, to enter the inlet 442, and the guide plate 52 serves as a shielding plate that prevents the water from leaking out. In other words, the guide body 51, the guide plate 52, and an outer surface of the drum base 42 may form a path where the water discharged from the cutting portion 423 moves.

Meanwhile, the drum base 42 may serve as a surface of a path connecting the upper surface 423*a* of the cutting portion 423 with the innermost surface 442*b* of the inlet 442. Also, the guide body 51 may form the outermost path of the water flowing from the cutting portion 423 to the inlet 442, and the guide plate 52 may form a lateral path so as to allow the water not to leak out.

Although the guide portion 5 may be provided in a single body with the outer circumference of the drum 4, the guide portion 5 may detachably be provided on the outer circumference of the drum 4. For example, one end of the guide body 51 may be inserted between the inlet 442 and the drum body 41, and the other end thereof may be in contact with the drum base 42 and may be fixed to the drum 4 by a fastening means such as a bolt and a nut.

It is preferable that the guide portion 5 is provided separately from the drum 4, that is, provided detachably from the drum 4 to ensure easiness in molding and manufacture of the drum 4.

Figure 3:
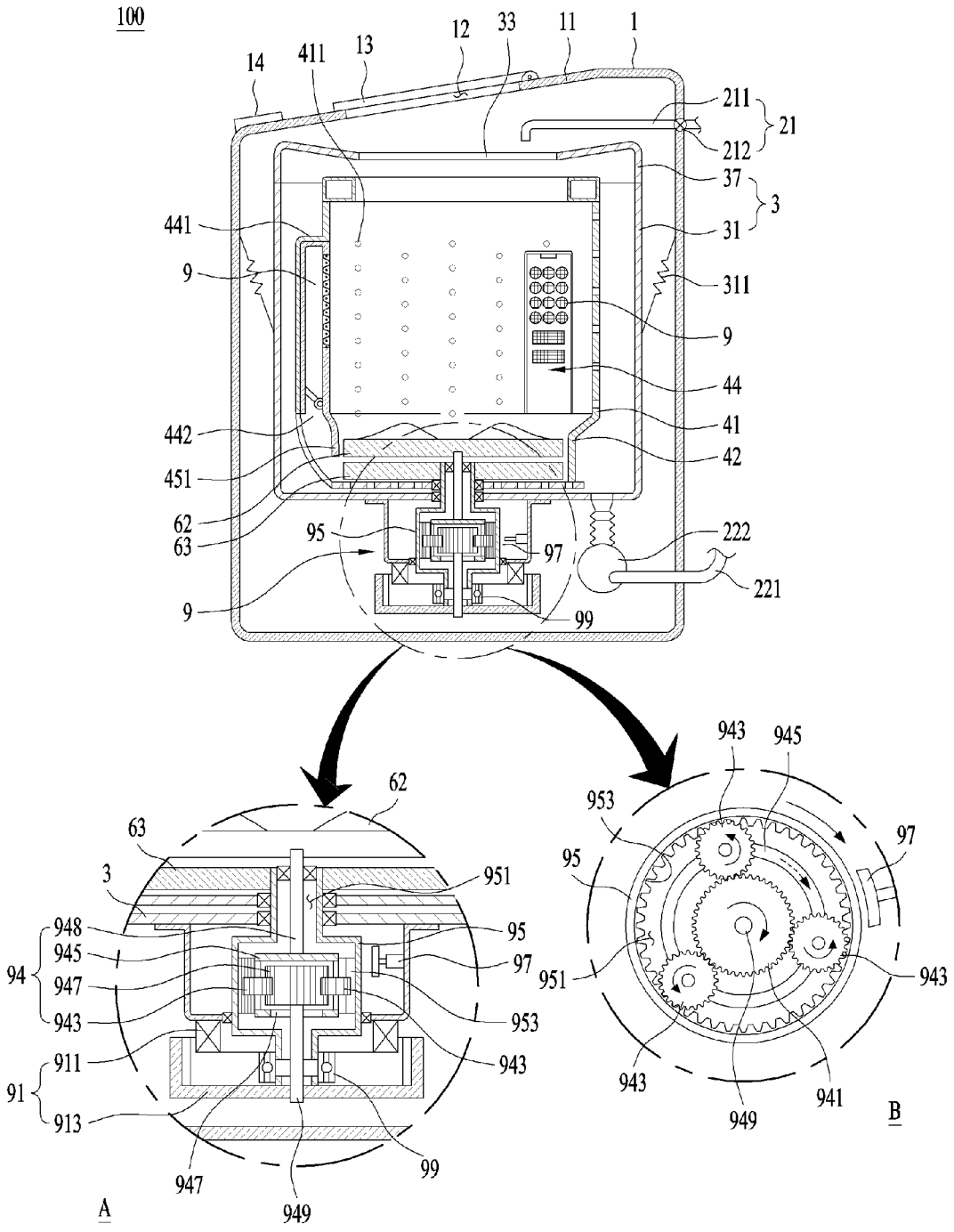
FIG. 3 illustrates another embodiment of a water flow formation portion and a driving portion.

FIG. 3 illustrates another embodiment of the water flow formation portion and the driving portion.

The water flow formation portion 6 according to one embodiment of the present invention may include an agitating blade 62 and a pumping blade 63, which are provided separately from each other.

The agitating blade 62 is provided as a pulsator, and may apply impact to laundry received in the drum 4 while rotating inside the drum 4, or may enhance washing efficiency by agitating the laundry, and the pumping blade 63 may be rotated by being received in the drum base 42 and serve to push the washing water to the path portion 44.

That is, the water flow formation portion 6 according to one embodiment of the present invention may include a member serving to stir the laundry and a member serving to circulate the water, separately from each other.

The agitating blade 62 and the pumping blade 63 may be rotated along the same direction, or may be rotated along their respective directions different from each other. Moreover, the agitating blade 62 and the pumping blade 63 may be rotated at their respective speeds different from each other.

The driving portion 9 may include a blade rotational shaft 95 rotating the pumping blade 63, an agitating blade rotational shaft 94 provided to pass through the blade rotational shaft 95, rotating the agitating blade 62, a motor 91 rotating the agitating blade rotational shaft 94, and a clutch 99 delivering a rotation power generated by the motor 91 to the blade rotational shaft 95.

The blade rotational shaft 95 passes through the bottom of the tub body 31 and is fixed to the bottom of the drum body 41, and includes a shaft through hole 951 provided along a length direction of the blade rotational shaft 95 inside the blade rotational shaft 95, and a coupling gear 953 provided in the shaft through hole 951.

The agitating blade rotational shaft 94 may include a first shaft 949 fixed to the rotor, a main driving gear 941 rotatably provided inside the shaft through hole 951 and fixed to the first shaft 949, a plurality of driven gears 943 arranged along a circumferential surface of the main driving gear 941, coupling the main driving gear 941 with the coupling gear 953, a cage 945 rotatably provided inside the shaft through hole 951, rotatably fixing the plurality of driven gears 943, and a second shaft 948 connecting an upper surface of the cage 945 with the agitating blade 62.

One end of the second shaft 948 is fixed to the upper surface of the cage 945, and the other end of the second shaft 948 is fixed to the agitating blade 62 by passing through the bottom of the drum body 41.

The clutch 99 is a means connecting the drum rotational shaft 95 to the rotor 913, and is provided to reciprocate between the blade rotational shaft 95 and the rotor 913 through a separate clutch driving portion (not shown).

The rotor 913 is provided with a clutch fastening unit (not shown) for gear-coupling the rotor with the clutch, and the blade rotational shaft 95 is provided with a clutch fastening unit (not shown) for gear-coupling the drum rotational shaft with the clutch, on its outer circumference. Therefore, if the clutch 99 couples the blade rotational shaft 95 with the rotor 913 through the clutch driving portion, the drum rotational shaft 95 will be rotated together with the rotor when the rotor is rotated.

In the laundry treating apparatus 100 having the aforementioned structure, if the clutch 99 couples the rotor 913 with the drum rotational shaft 95 (A), the agitating blade and the pumping blade are rotated along the same direction at the same time.

For example, as shown in A of FIG. 3, if the rotor 913 is rotated in a state that the clutch 99 couples the rotor 913 with the first shaft 949, the blade rotational shaft 95 will be rotated clockwise, whereby the pumping blade 63 will be rotated clockwise.

Meanwhile, as shown in B of FIG. 3, if the rotor 913 is rotated clockwise, the first shaft 949 and the main driving gear 941 are rotated clockwise. If the main driving gear is rotated clockwise, the driven gears 943 will be rotated counterclockwise, and the cage 945 will be rotated clockwise. Therefore, the second shaft 948 fixed to the cage 945 will be rotated clockwise, and the agitating blade 62 will be rotated clockwise by the second shaft 948.

However, if the rotor 913 is rotated clockwise in a state that the clutch 99 releases coupling between the rotor 913 and the first shaft 949, the agitating blade 62 is rotated clockwise by the aforementioned process.

Meanwhile, if the rotor 913 is rotated clockwise in a state that the clutch 99 releases coupling between the rotor 913 and the first shaft 949, the pumping blade 63 is rotated counterclockwise (not shown). Even in the case that the clutch 99 does not couple the rotor 913 with the drum rotational shaft 95, the drum rotational shaft 95 is rotated due to a repulsive force that acts on the coupling gear 953 when the driven gears 943 are rotated.

When the rotor 913 is rotated in a state that the clutch 99 releases coupling between the rotor 913 and the first shaft 949, the driving portion 9 may further include a brake 97 for controlling rotation of the drum rotational shaft 95. The brake 97 may be provided to be in contact with the blade rotational shaft 95 by a brake driving unit (not shown).

Unlike the aforementioned description, the driving portion 9 may include a motor for controlling only rotation of the agitating blade 62 or a motor for controlling only rotation of the pumping blade 63.

As a result, the agitating blade 62 and the pumping blade 63 may be rotated at their respective speeds different from each other, and their rotational speeds may be controlled by controlling the number of gear teeth of the aforementioned gears.

As a result, the amount of the water entering the path portion 44 may be controlled.

Since the configuration of the driving portion 9 is only exemplary for understanding of the present invention, the agitating blade 62 and the pumping blade 63 may be rotated respectively, or may be provided even in any configuration if their respective rotational speeds are provided.

Figure 4A:
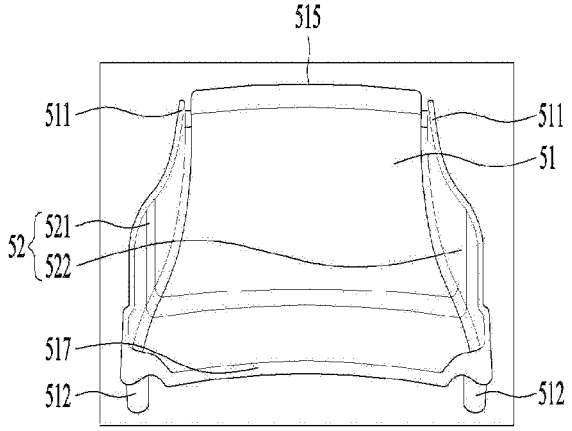
FIG. 4(*a*) illustrates a guide portion according to an embodiment of the invention.

FIG. 4 illustrates the guide portion 5 and the drum base 42.

The guide body 51 may include an inlet portion 515 into which the water flows from the cutting portion 423, and an outlet portion 517 for discharging the water to the inlet 442.

A length or area of the outlet portion 517 may be provided to be smaller than that of the inlet portion 515. This is to preserve a pressure value lost as the outlet portion 517 is provided to be higher than the inlet portion 515.

That is, since the area of the outlet portion 517 is smaller than that of the inlet portion 515, the guide portion 5 may maintain a sufficient pressure for discharging the water to the outlet portion 517.

The guide body 51 may include a first fastening portion 511 provided in the outlet portion 517 and fastened to the inlet 442, and a second fastening portion 512 provided in the inlet 515 and fastened to the bottom surface 422*d*.

Although FIG. 4 illustrates that the first fastening portion 511 is provided as a groove provided at both sides of the guide body 51, and the second fastening portion 512 is provided as a groove provided at both sides of the guide body 51 to allow a bolt to be inserted thereinto, the grooves of the first fastening portion and the second fastening portion may be modified depending on structures and fastening methods of the inlet 442 and the bottom surface 422*b*.

Figure 4B:
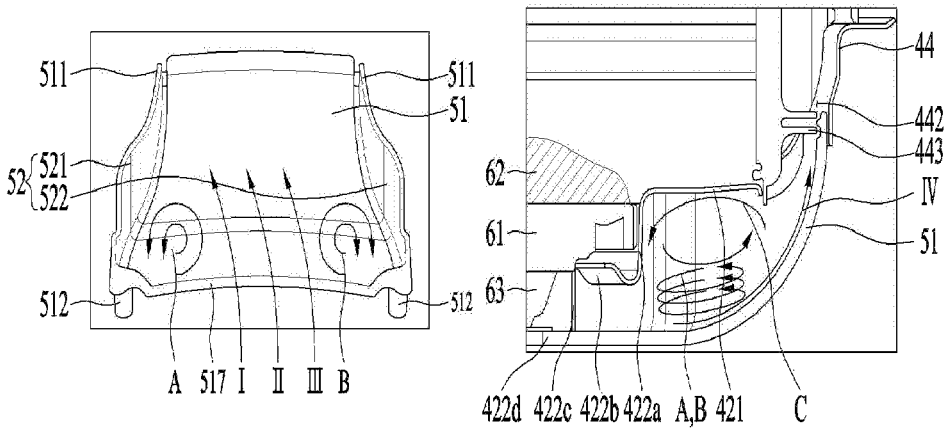

Referring to FIG. 4*b*, the inlet 442 is provided with a protrusion 443, whereby the first fastening portion 511 is inserted into the protrusion, and the inlet 515 is bolted in contact with the bottom surface 422*b*.

Also, the guide plate 52 may include a first guide plate 521 provided at one side of the guide body 51, and a second guide plate 522 provided at the other side of the guide body 51.

As described above, the first guide plate 521 and the guide plate 522 may form the path of the guide portion 5 together with the guide body 51.

Figure 4C:
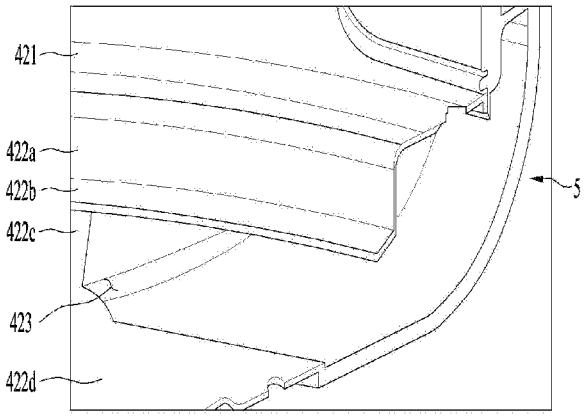

Referring to FIG. 4*c*, the water pushed by the pumping blade 63 enters the inlet portion 515 through the cutting portion 423, and reaches the outlet portion 517 by means of the pressure based on the rotational force of the pumping blade 63, thereby entering the inlet 442 of the path portion 44.

Meanwhile as shown in FIG. 4*b*, the water pushed by rotation of the pumping blade 63 enters the inlet portion 515 along directions I, II and III.

At this time, the water does not enter the input portion 515 in a straight line. For example, if the pumping blade 63 is rotated in a left direction, the water is slanted or curved from the right to the left in the same manner as the directions I, II and II and then enters the inlet portion 515.

Since the water entering the inlet portion 515 in the direction II is far away from the guide plate 52 at a sufficient distance, the water may directly move to the outlet portion 515 without any resistance, whereas the water entering the inlet portion 515 in the direction I is affected by flow resistance of the first guide plate 521. This is because that the water entering the inlet portion 515 in the direction I partially collides with the first guide plate 521.

As a result, the water entering the inlet portion 515 in the direction I is relatively slower than the speed of the water entering the inlet portion 515 in the direction II, whereby vertex of a counterclockwise direction is formed as shown in the area A of FIG. 4B.

Also, although the water entering the inlet portion 515 in the direction III may directly move to the outlet portion 515, the water may fail to enter the outside of the second guide plate 522 due to the second guide plate 522, whereby the pressure is lowered at a portion of the second guide plate 522.

Therefore, the water entering the inlet portion 515 in the direction III is partially curved toward the second guide plate 522, and forms vortex of a clockwise direction as shown in the area B of FIG. 4B.

If the pumping blade 62 is rotate in a right direction, the shape of the vortex and the directions I, II and III are varied in a line symmetry but the other details are maintained equally.

The vortex of the clockwise direction or the counterclockwise direction disturbs a flow of the water entering the guide portion 5, and the water equivalent to the volume of the areas A and B of the vortex does not enter the path portion 44, whereby the water entering the path portion 44 is reduced.

At this time, if the filter portion 7 is provided in the path portion 44, the water is not supplied to the filter portion 7 sufficiently, whereby a filtering capability of particles is remarkably deteriorated, and the circulating amount of the path portion 44 for circulating the water at the lower portion of the drum 4 toward the upper portion thereof is very reduced.

Moreover, as shown in FIGS. 4*b* and 4*c*, if the circumference portion 421 and the receiving portion 422 are provided to form a step difference and the cutting portion 423 is provided in the receiving portion 422, the water entering the cutting portion 423 passes through the path which is unexpectedly enlarged from the guide body 51 to the outer wall of the circumference portion 421.

That is, since the height from the guide body 51 to the outer wall of the circumference portion 421 is higher than the height of the cutting portion 423, enlargement of the path is caused. Therefore, since the path is rapidly enlarged, the pressure of the water passing through the cutting portion 423 is rapidly lowered.

Also, the water entering the cutting portion 423 is pushed toward the inlet 442 by the pumping blade 63 and then moves in a direction IV (see FIG. 4*b*). At this time, the pressure caused by the pumping blade 63 is not delivered to the outer wall of the circumference portion 421. Therefore, the water moving in the direction IV partially enters the area C due to the aforementioned cause, and generates vortex in the area C.

A problem occurs in that the water equivalent to the volume corresponding to the area C does not enter the inlet 442 due to the vortex of the area C.

Therefore, a separate structure for maintaining performance of the filter portion 9 provided in the path portion 44 and reducing the vortex of the areas A, B and C to allow the considerable amount of water to continuously enter the path portion 44 may be required.

In this respect, the laundry treating apparatus according to one embodiment of the present invention may further include an anti-vortex member 53 provided in the guide portion 5 to prevent the vortex from being generated or reduce the vortex areas.

Figure 5A:
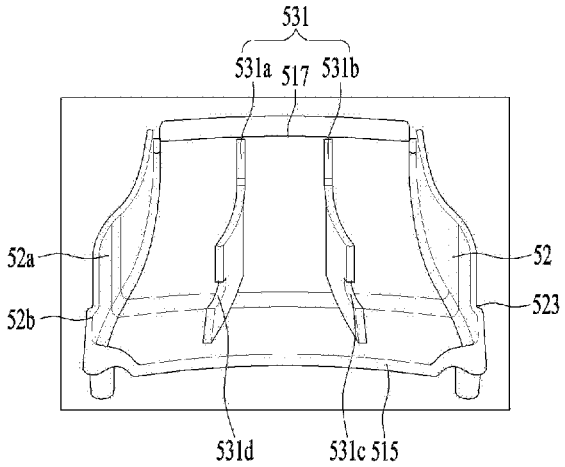
FIG. 5(*a*) illustrates an anti-vortex member provided in a guide portion according to an embodiment of the invention FIG. 5(*b*) further illustrates the anti-vortex member provided in the guide portion illustrated in FIG. 5(*a*)
Figure 5B:
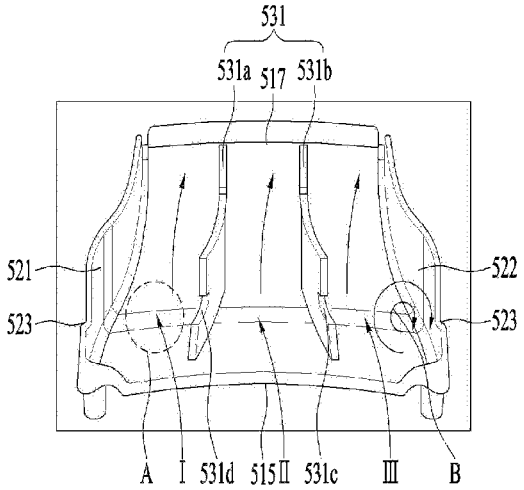
Figure 5C:
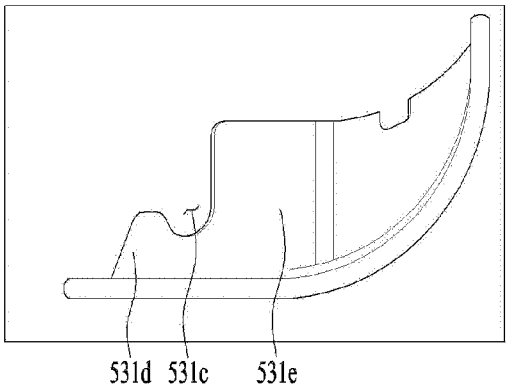
Figure 6A:
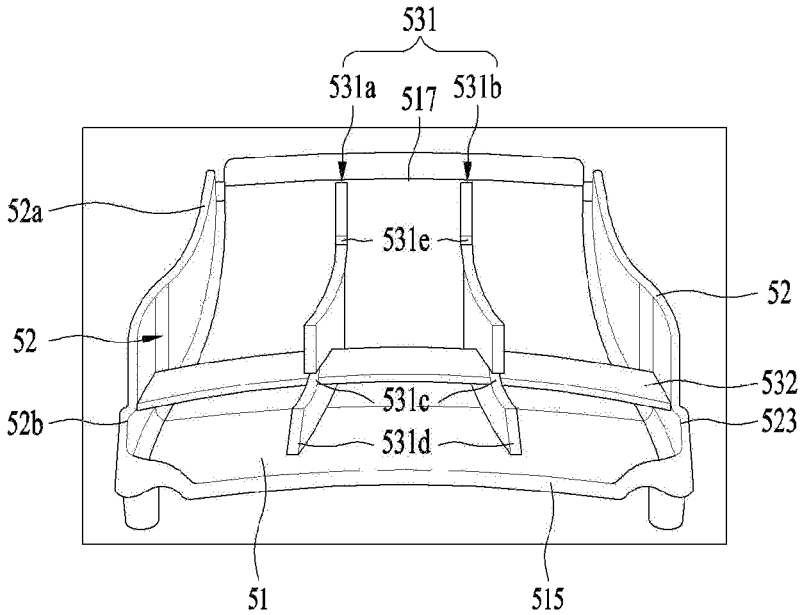
FIG. 6(*a*) illustrates an anti-vortex member provided in a guide portion according to another embodiment of the invention.
Figure 6B:
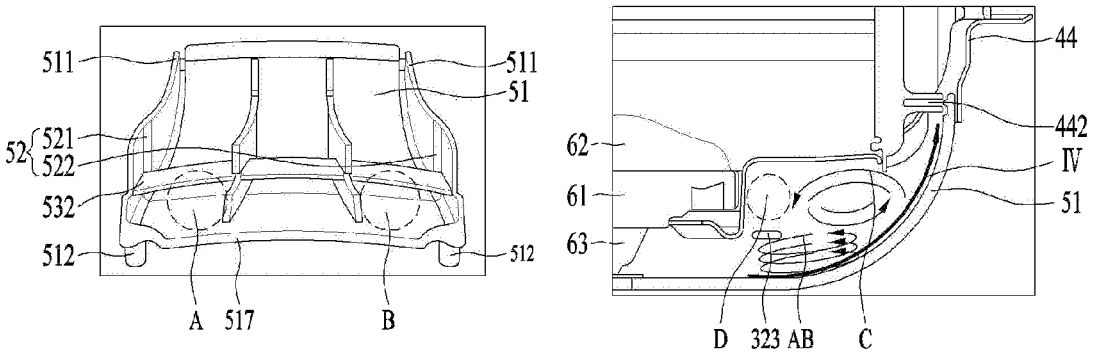
Figure 7A:
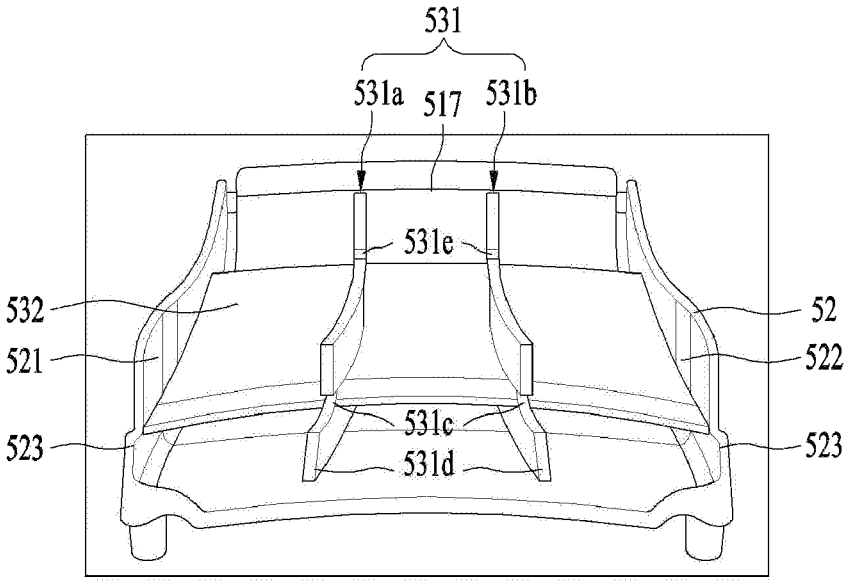
FIG. 7(*a*) illustrates an anti-vortex member provided in a guide portion according to another embodiment of the invention.
Figure 7B:
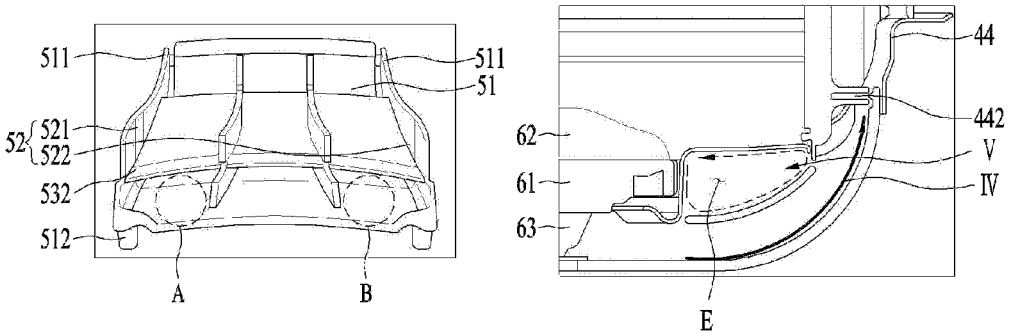

FIGS. 5 to 7 illustrate various examples of the anti-vortex member 53 for reducing the vortex areas.

Referring to FIG. 5, the anti-vortex member may include at least one or more of guide ribs 531 provided between the guide plates 52 and extended from the inlet portion 515 to the outlet portion 517 to partition the guide body 51.

As shown in FIG. 5(*a*), the guide rib 531 may include a first guide rib 531*a* spaced apart from the guide plate 52 provided at one side of the guide body 51 at a certain interval, and a second guide rib 531*b* spaced apart from the guide plate 52 provided at the other side of the guide body 51 at a certain interval.

The first guide rib 531*a* may be provided to be spaced apart from the first guide plate 521 at a certain interval, and the second guide rib 531*b* may be provided to be spaced apart from the second guide plate 522 at a certain interval.

Referring to FIG. 5(*b*), the water entering the inlet portion 515 in the direction II may enter between the first guide rib 531*a* and the second guide rib 531*b* and then move to the outlet portion 517. That is, the water entering the inlet portion 515 in the direction II is separated from the water entering the inlet portion 515 in the direction I, whereby the water entering the inlet portion 515 in the direction II does not affect the pressure or flow rate of the water entering the inlet portion 515 in the direction I.

Also, the water entering the inlet portion 515 in the direction I may enter the outlet portion 517 along the first guide plate 521 as it is.

Therefore, an area where the pressure of the water between the first guide plate 521 and the first guide rib 531*a* is relatively lowered disappears. Therefore, occurrence of vortex in the area A may be avoided.

Also, the water entering in the direction III is concentrated on the second guide rib 531*b* and the second guide plate 52 by the second guide rib 531*b*, and the pressure of the area B may be recovered. Therefore, the area of vortex generated in the area B may be reduced, or occurrence of vortex may be avoided.

As a result, the area of vortex of the guide portion 5 may be reduced or occurrence of vortex may be avoided by the anti-vortex member 53 comprised of the guide rib 531, whereby the flow rate of the water entering the path portion 44 may be ensured.

Only one guide rib 531 may be provided unlike the shown drawing. However, it is preferable that at least two guide ribs 531 or more are provided to inhibit occurrence of vortex in the areas A and B if possible.

The first guide rib 531*a* and the second guide rib 531*b* may be provided to be close to each other from the inlet portion 515 to the outlet portion 517.

That is, as the first guide rib 531*a* and the second guide rib 531*b* becomes close to each other, the path may become narrow. As a result, loss of the pressure, which is caused by a higher flow rate of the water, may be avoided.

Referring to FIG. 5(*c*), the guide rib 531 may include a front guide rib 531*d* extended from the guide body 51 at a relatively low height, and a rear guide rib 531*e* provided in a single body with the front guide rib 531*d* and extended from the guide body 51 at a height higher than the front guide rib 531*d*.

Also, a rib groove 531*c* provided by bending the guide rib 531 may be provided between the front guide rib 531*d* and the rear guide rib 531*e*.

That is, since the receiving portion 422 is provided to have a step difference, the guide rib 513 may be provided to correspond to the shapes of the first and second step difference surface3s 422*a*, 422*b* and 422*c* of the receiving portion 422.

In other words, when the guide portion 5 is attached to the outer wall of the circumference portion 421 and the receiving portion 422, the front guide rib 531*d* may support the upper surface of the cutting portion 532 while the rear guide rib 531*e* may support the outer wall of the circumference portion 421.

Also, the rib groove 531*c* may receive the third step difference surface 422*c* of the receiving portion 422. As a result, the guide portion 5 and the drum 4 may be closely adhered to each other, whereby their coupling force may be more improved.

Moreover, the guide plate 52 may include a front guide plate 52*a* supporting the second step difference surface and a rear guide plate 52*b* provided in a single body with the front guide plate 52*a*, supporting the circumference portion. The guide plate 52 may be provided to have a shape the same as or similar to that of the guide rib 531.

FIG. 6 illustrates another example of the anti-vortex member 53.

Referring to FIG. 6(*a*), the anti-vortex member 53 may further includes a partition portion 532 spaced apart from the guide body 51 at a certain interval, connecting the guide plates 52 with each other.

The partition portion 532 may be provided to be spaced apart from the guide body 51 at a height the same as or higher than that of the cutting portion 423, whereby the guide portion 5 may be in contact with one surface of the receiving portion 422 when the guide portion 5 is coupled to the drum 4.

The partition portion 532 may be provided to be extended to be parallel with the bottom of the tub 3 at a certain length.

Although FIG. 6(*a*) illustrates that the guide rib 531 is included in the anti-vortex member 53, the anti-vortex member 53 may include the partition portion 53 only.

FIG. 6(*b*) illustrates a cross-section when guide portion 5 is coupled to the drum 4.

The partition portion 532 may be provided in contact with one surface of the receiving portion 422, that is, the outer wall of the third step difference surface 422*a* when the guide portion 5 is coupled to the drum 4.

As shown, the partition portion 532 may be provided in parallel with the bottom of the tub 3, or may be provided at a height the same as or higher than that of the upper surface of the cutting portion 423.

As a result, the water passing through the cutting portion 423 may move along one surface of the partition portion 532 without being directly enlarged to the outer wall of the circumference portion 521.

Therefore, the water passing through the cutting portion 423 may directly move in a state that the path is not enlarged. That is, the water may enter the inlet portion 515 to reach the end of the partition portion 532 without loss of the pressure. As a result, occurrence of vortex in the area D of the area C, which is above the partition portion, may be inhibited.

Therefore, occurrence of vortex may be inhibited as much as the volume of the area D, whereby the flow rate of the water entering the path portion 44 may be ensured.

At this time, if the anti-vortex member 53 is simultaneously provided with the partition portion 532 and the guide rib 531, occurrence of vortex in the areas A, B and C may be avoided, and the flow rate of the water entering the path portion 44 may be ensured as much as the volume of the areas A, B and C.

If the anti-vortex member 53 is simultaneously provided with the partition portion 532 and the guide rib 531, the partition portion 532 may be provided in the rear guide rib 531*e* at the same height as that of the front guide rib 531*d*. This is to generate an effect that the partition portion 532 is extended from the upper surface of the cutting portion 532. In the strict sense, the partition portion 532 may be provided at one side of the rib groove 532*c*.

FIG. 7 illustrates still another example of the anti-vortex member 53.

Referring to FIG. 7(*a*), the anti-vortex member 53 may be provided in such a manner that the partition portion 532 is spaced apart from the guide body 51 at a certain interval to connect the guide plates with each other and extended in parallel with the guide body 51 toward the inlet 442 from the upper surface of the cutting portion 423 if the guide portion 5 is coupled to the drum 4.

Referring to FIG. 7(*b*), the partition portion 532 may be provided to be spaced apart from the inlet portion 442 at a certain distance. That is, the partition portion 532 may be provided at a height lower than that of the outlet portion 517.

This is to allow the partition portion 532 not to disturb coupling between the guide portion 5 and the drum 4 as the guide body 51 is bent and the drum base 42 is provided in a complicated structure.

That is, the partition portion 532 shown in FIG. 7 is provided to be longer than the partition portion 532 shown in FIG. 6. Therefore, occurrence of vortex in the area C may be inhibited. As a result, occurrence of vortex of more volume may be inhibited, whereby the flow rate of the water entering the path portion 44 may be ensured.

Figure 8A:
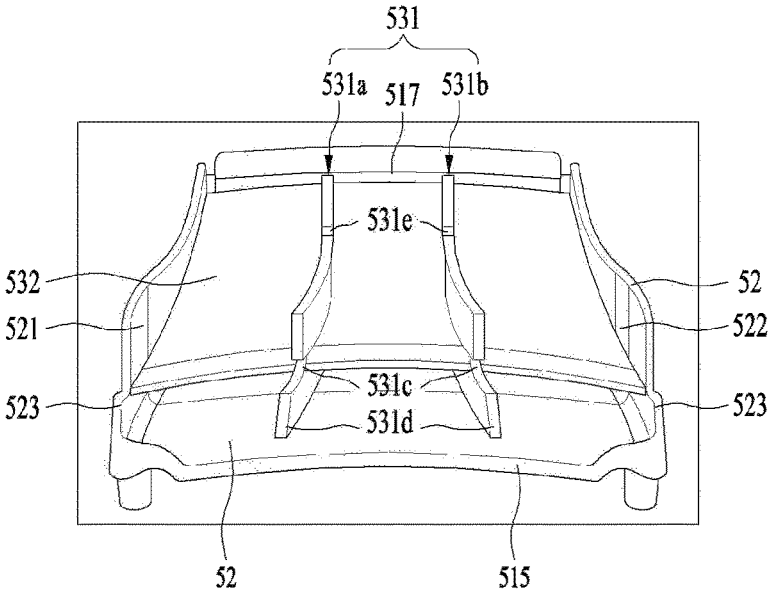
FIG. 8(*a*) illustrates an anti-vortex member provided in a guide portion according to another embodiment of the invention.
Figure 8B:
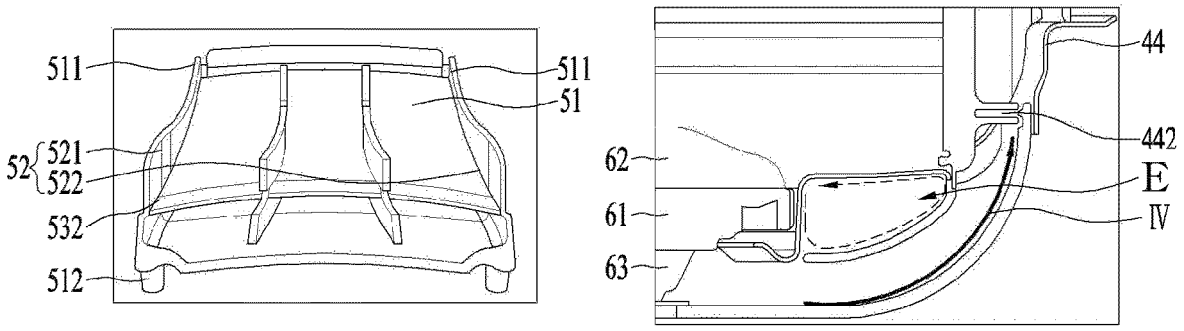

FIG. 8 illustrates a final example of the anti-vortex member 53.

Referring to FIG. 8(*a*), the anti-vortex member 53 may be provided in such a manner that the partition portion 532 is spaced apart from the guide body 51 at a certain interval to connect the guide plates with each other and extended to connect the upper surface of the cutting portion 423 to the innermost surface of the inlet 442 when the guide portion 5 is coupled to the drum 4.

At this time, the end of the partition portion 532 may be provided at a height the same as or lower than the outlet portion 517 at a certain interval.

Referring to FIG. 8(*b*), since the partition portion 532 connects the upper surface of the cutting portion 423 with the innermost surface of the inlet 442, the water may be prevented from entering the area C (see line IV of FIG. 7).

Also, even though the water may enter the area C at a certain amount, occurrence of vortex may be avoided completely.

Also, if the anti-vortex member 53 further includes the guide rib 531 as shown in FIG. 8, occurrence of vortex in all areas of the guide portion may be inhibited.

Therefore, the water entering the cutting portion 423 may be delivered to the inlet 442 as it is.

Although FIGS. 5 to 8 illustrate that the anti-vortex member 53 is provided in a single body with the guide portion, the anti-vortex member 53 may be provided as a separate member different from the guide portion 5.

That is, the anti-vortex member 53 may be provided detachably from the guide portion 5.

The guide rib 531 and the partition portion 532 have their complicated shapes and curvatures. Since the guide body 51 serves as a vane, the guide body 51 also has a curvature. Therefore, if the anti-vortex member 53 and the guide body 51 are provided in a single body, it may be difficult to perform injection molding.

At this time, the anti-vortex member 53 may be provided detachably from the guide portion 5 to solve the above problem. The shape of the anti-vortex member 53 may be provided more complicatedly, whereby occurrence of vortex may be avoided more effectively.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A laundry treating apparatus comprising:

a cabinet;

a tub disposed inside the cabinet to receive water;

a drum rotatably disposed inside the tub, the drum comprising:

a cylindrical drum body providing a space for storing laundry, and a drum base disposed at a lower surface of the drum;

a path portion comprising:

a path body disposed inside the drum body, the path body forming a path through which the water located near the drum base moves to an upper side of the drum body, and an inlet provided below the path body to allow the water to enter the path portion;

a water flow formation portion rotatably provided on the drum base to at least partially discharge the water inside the drum to the path portion during rotation; and a guide portion comprising:

a guide body to guide the water discharged by the water flow formation portion to the path portion, and a guide plate forming a lateral path so as to prevent leakage of the water moving in the guide body; and an anti-vortex member to prevent a vortex of the water from passing through the guide portion, wherein the drum base comprises a cutting portion provided to pass through the drum base so as to deliver the water received in the drum to the path portion, wherein the guide body connects a lower portion of the cutting portion with a outermost surface of the inlet, wherein a first end of the guide body is inserted between the inlet and the drum body and a second end of the guide body is in contact with the drum base, and wherein the guide plate is disposed at both sides of the guide body, the guide plate coupling both sides of the cutting portion with both sides of the inlet respectively.

2. The laundry treating apparatus of claim 1, wherein the drum comprises:

a cylindrical drum body providing a space for storing laundry, and a drum base disposed at a lower surface of the drum body, wherein the drum base comprises:

a circumference portion that extends from the drum body to form an outer circumference of the drum base, the circumference portion having an inlet in communication with the path portion, and a receiving portion that extends from an inner circumference of the circumference portion to provide a space where the water flow formation portion is received, the receiving portion having a cutting portion provided at one side thereof to allow the water to be discharged by the water flow formation portion.

3. The laundry treating apparatus of claim 2, wherein the path portion comprises:

a path body disposed in the drum body, the path body forming a path through which the water located near the drum base is moved to an upper side of the drum body, and an inlet provided below the path body to allow the water to enter the path portion.

4. The laundry treating apparatus of claim 3, wherein the guide portion is detachably provided in the drum, the guide portion comprising:

a guide body to couple a lower surface of the cutting portion with an outermost surface of the inlet, and a guide plate disposed at both sides of the guide body, the guide plate coupling both sides of the cutting portion with both sides of the inlet to form a path that prevents leakage of the water moving in the guide body.

5. The laundry treating apparatus of claim 1, wherein the guide body comprises:

an inlet portion provided at a first end thereof into which the water flows from the cutting portion, and an outlet portion provided a second end thereof to discharge the water to the inlet, whereby the anti-vortex member comprises at least one guide rib extended from the inlet portion to the outlet portion to partition the guide body.

6. The laundry treating apparatus of claim 5, wherein the at least one guide rib is disposed at a center of the guide body.

7. The laundry treating apparatus of claim 5, wherein the at least one guide rib comprises:

a first guide rib spaced apart from the guide plate and provided at a first side of the both sides of the guide body, and a second guide rib spaced apart from the guide plate and provided a second side of the both sides of the guide body.

8. The laundry treating apparatus of claim 5, wherein the guide body comprises:

an inlet portion disposed at one end of the guide body into which the water flows from the cutting portion, and an outlet portion to discharge the water to the inlet, wherein the anti-vortex member further comprises a partition portion that connects to the guide plate disposed at both sides of the guide body.

9. The laundry treating apparatus of claim 8, wherein the partition portion is spaced apart from the guide body at a height the same as or higher than the height of the cutting portion.

10. The laundry treating apparatus of claim 9, wherein the partition portion extends parallel with a bottom surface of the tub.

11. The laundry treating apparatus of claim 9, wherein the partition portion extends from an upper surface of the cutting portion to the inlet and is parallel with the guide body, the partition portion being spaced apart from the inlet.

12. The laundry treating apparatus of claim 9, wherein the partition portion extends from an upper surface of the cutting portion to an innermost surface of the inlet.

13. The laundry treating apparatus of claim 7, wherein the water flow formation portion comprises:

a water flow forming body forming a main body, an agitating blade that protrudes from the water flow forming body, and a pumping blade that protrudes below the water flow forming body to discharge the water from the drum base.

14. The laundry treating apparatus of claim 13, wherein the receiving portion comprises:

a first step difference surface that extends from an inner circumference of the circumference portion to a lower portion thereof, a second step difference surface that extends from the first step difference surface and is parallel with the bottom of the tub, a third step difference surface that extends from an inner circumference of the second step difference surface to a lower portion thereof, and a bottom surface that extends from the third step difference surface and is parallel with the bottom of the tub, whereby the first and second step difference surfaces respectively provide space for receiving the water flow forming body, and the third step difference surface and the bottom surface respectively provide space for receiving the pumping blade.

15. The laundry treating apparatus of claim 13, wherein the guide plate comprises:

a front guide plate that supports the second step difference surface, and a rear guide plate that is integral with the front guide plate and supports the circumference portion, and wherein the at least one guide rib comprises:

a front guide rib that supports the second step difference surface, and a rear guide rib that is integral with the front guide rib and supports the circumference portion.

16. The laundry treating apparatus of claim 15, wherein the anti-vortex member further comprises:

a partition portion that is parallel with the guide body at a height that is the same as the front guide plate and the front guide rib, the partition portion being in contact with the third step difference surface provided with the cutting portion by connecting the rear guide plate with the rear guide rib.

17. The laundry treating apparatus of claim 16, wherein the partition portion extends parallel with a bottom surface of the tub.

18. The laundry treating apparatus of claim 16, wherein the partition portion extends from an upper surface of the cutting portion to the inlet and is parallel with the guide body, the partition portion being spaced apart from the inlet.

19. The laundry treating apparatus of claim 16, wherein the partition portion extends from an upper surface of the cutting portion to the innermost surface of the inlet.

20. The laundry treating apparatus according to claim 7, wherein the water flow formation portion comprises:

an agitating blade that is exposed inside the drum, and a pumping blade that rotates and is spaced apart from the agitating blade, whereby the agitating blade and the pumping blade are rotatable in different directions from each other or at different speeds from each other.

* * * * *